US008418275B1

(12) United States Patent
Dondurur et al.

(10) Patent No.: US 8,418,275 B1
(45) Date of Patent: Apr. 16, 2013

(54) SYSTEM FOR UNCLOGGING TOILETS

(75) Inventors: Mehmet Dondurur, Crofton, MD (US); Ahmet Z. Sahin, Dhahran (SA)

(73) Assignee: King Fahd University of Petroleum and Minerals, Dhahran (SA)

( * ) Notice: Subject to any disclaimer, the term of this patent is extended or adjusted under 35 U.S.C. 154(b) by 0 days.

(21) Appl. No.: 13/312,911

(22) Filed: Dec. 6, 2011

(51) Int. Cl.
*E03D 9/00* (2006.01)

(52) U.S. Cl.
USPC ..... 4/255.04; 4/255.05; 4/255.07; 4/255.09

(58) Field of Classification Search ..... 4/255.01–255.12
See application file for complete search history.

(56) References Cited

U.S. PATENT DOCUMENTS

| | | | |
|---|---|---|---|
| 3,608,098 | A | 9/1971 | Andrisani |
| 6,205,594 | B1 | 3/2001 | Solaberry |
| 6,907,622 | B2 | 6/2005 | Rasaei et al. |
| 7,877,821 | B1 | 2/2011 | Prestia |
| 2003/0028957 | A1 | 2/2003 | Kawai |
| 2005/0050624 | A1 | 3/2005 | Pangramuyen |
| 2007/0266485 | A1 | 11/2007 | Tackett |
| 2008/0244819 | A1 | 10/2008 | Meador |

FOREIGN PATENT DOCUMENTS

| | | |
|---|---|---|
| WO | WO 93/14273 A1 | 7/1993 |

*Primary Examiner* — Tuan N Nguyen
(74) *Attorney, Agent, or Firm* — Richard C. Litman

(57) ABSTRACT

The system for unclogging toilets is a pressurized air-based unclogging system for toilets, allowing clogs formed on either side of a bend in a toilet outflow pipe to be cleared simultaneously. The system includes a tube mounted on a toilet so that a pair of peripheral apertures and a central aperture formed through a lower end thereof communicate with an interior of the bend of the pipe. A plunger is slidably mounted within an interior of the tube, and has an expandable bladder mounted thereto. An air pump delivers pressurized air to the interior of the tube through a port formed through an upper end thereof so that the plunger is driven downward while simultaneously filling the expandable bladder, which projects through the central aperture. The expandable bladder creates a barrier within the bend and pressurized air flowing through the peripheral apertures is delivered to either side of the bend.

6 Claims, 3 Drawing Sheets

SYSTEM FOR UNCLOGGING TOILETS

BACKGROUND OF THE INVENTION

1. Field of the Invention

The present invention relates to plumbing, and particularly to a system for unclogging toilets utilizing pressurized air to break up clogs formed on either side of a bend formed in a toilet outflow pipe.

2. Description of the Related Art

Clogs formed in the pipes of toilets are very common. Toilet plungers are the most common tool for clearing toilet clogs. Although plungers are useful tools in unclogging most toilets, they are not sanitary instruments. In use, contaminated water may easily be sprayed or spilled during the unclogging process, along with the contaminated water dripping off of the plunger following use thereof. Additionally, plungers may be used for most clogs, but are not effective for all clogs. For more serious clogs, harsh chemicals or plumbing snakes or drain augers are typically used. The common household user, however, tends to avoid the use of harmful and toxic chemicals when possible, and plumbing snakes are typically only employed by professional plumbers. Further, snakes, wires and the like can cause damage to the interior of the pipe. It would be desirable to provide the effectiveness of the plumbing snake in a convenient system, readily adaptable to a common household toilet, and without the possibility of damaging the interior of the pipe.

Thus, a system for unclogging toilets solving the aforementioned problems is desired.

SUMMARY OF THE INVENTION

The system for unclogging toilets is a pressurized air-based unclogging system for toilets, allowing clogs formed on either side of a bend in a toilet outflow pipe to be cleared simultaneously. The system includes a hollow tube having opposed closed upper and lower ends. The upper end has a port formed therethrough and the lower end has a pair of peripheral apertures and a central aperture formed therethrough. The hollow tube is mounted on a toilet so that the pair of peripheral apertures and the central aperture are in communication with an interior of the bend of the toilet outflow pipe.

A plunger is slidably mounted within an interior of the hollow tube. The plunger has a pair of diametrically opposed recesses formed in a peripheral edge thereof for respectively receiving a pair of conduits. The plunger further has a central opening formed therethrough. The plunger forms a fluid-tight seal with an interior wall of the hollow tube and external walls of the pair of conduits.

An expandable bladder having opposed fixed and free ends is provided. The fixed end is open and the free end is closed. The fixed end is secured to a lower surface of the plunger about the central opening formed therethrough. The free end extends through the central aperture of the lower end of the hollow tube.

An air pump selectively delivers pressurized air to the interior of the hollow tube through the port formed through the upper end of the hollow tube, so that the plunger may be selectively driven downward within the hollow tube while simultaneously filling the expandable bladder. The expandable bladder forms a barrier separating opposed sides of the bend of the pipe, while pressurized air flowing through the pair of conduits may break up clogs formed on either side of the bend of the toilet outflow pipe when the pressurized air is delivered to the interior of the hollow tube.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
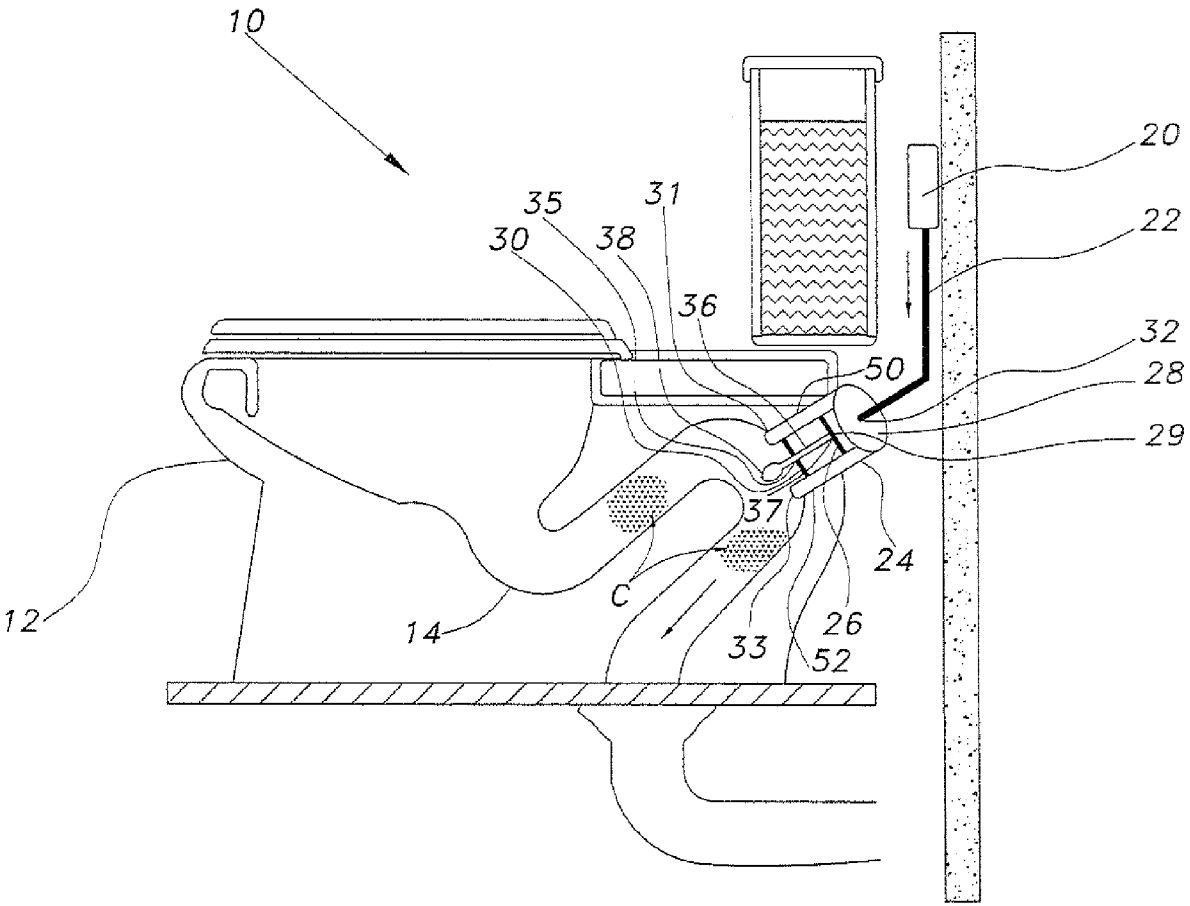
FIG. 1 is a diagrammatic side view in section of a system for unclogging toilets according to the present invention.

The system for unclogging toilets 10 is a pressurized air-based unclogging system for toilets, allowing clogs C formed on either side of a bend 18 in a toilet outflow pipe 14 to be cleared simultaneously. As shown in FIG. 1, the system 10 includes a hollow tube 24 having opposed closed upper and lower ends 28, 30, respectively. The upper end 28 has a port 32 formed therethrough. A pair of diametrically opposed conduits 50, 52 are mounted on the interior of the hollow tube 24, each conduit 50, 52 being fixed to the interior wall thereof. The upper ends of the conduits 50, 52 are positioned within the interior of the hollow tube 24, and the lower ends extend through peripheral apertures 31, 33 formed through the lower end 30 of the hollow tube 24. The hollow tube 24 is mounted on a toilet 12 so that the pair of peripheral apertures 31, 33 (and the lower ends of conduits 50, 52) are in communication with an interior of the bend 18 of the toilet outflow pipe 14. Thus, the interior of the hollow tube 24 is in fluid communication with the interior of the pipe 14 for delivery of pressurized air thereto, as will be described in greater detail below. The hollow tube 24 may be formed from any suitable material with the structural strength to allow for the input of pressurized air, as will be described in detail below.

Figure 2:
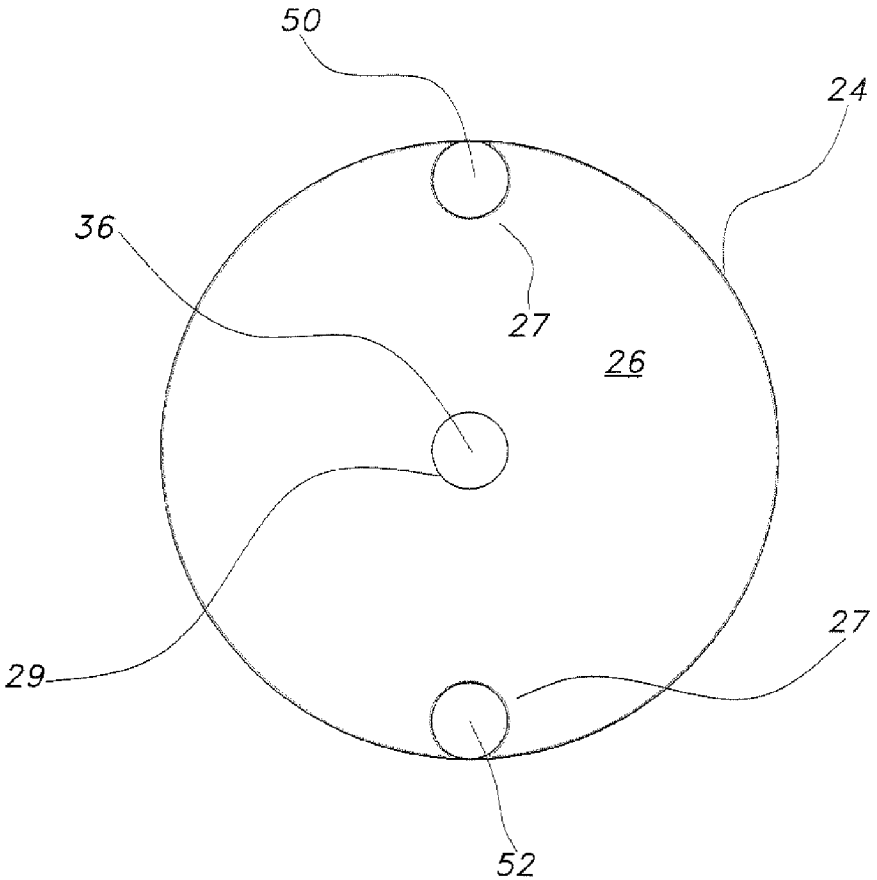
FIG. 2 is a diagrammatic top view in section of a hollow tube of the system for unclogging toilets of FIG. 1.

A plunger 26 is slidably mounted within the interior of the hollow tube 24. As best shown in FIG. 2, the plunger 26 includes has a pair of recesses 27 diametrically formed in the perimeter thereof for receiving the conduits 50, 52. Additionally, as will be described further below, a central opening 29 is formed through the plunger 26. The plunger 26 forms a fluid-tight seal with an interior wall of the hollow tube 24 and the external walls of the conduits 50, 52. Preferably, the hollow tube 24 is substantially cylindrical, and the plunger 26 preferably has a substantially circular perimeter for forming the fluid-tight seal with the interior wall of the tube 24. The recesses 27 form fluid-tight seals with the external walls of the conduits 50, 52.

A balloon or expandable bladder 36 is further provided. The expandable bladder 36 has opposed fixed and free ends, 37, 38, respectively, the fixed end 37 being open and being secured about the opening 29 formed through the plunger 26. The free end 38 extends through a central aperture 35 formed through the lower end 30 of the hollow tube 24.

An air pump 20 selectively delivers pressurized air to the interior of the hollow tube 24 through the port 32 formed through the upper end 28 of the hollow tube 24 so that the plunger 26 may be selectively driven downward within the hollow tube 24 while simultaneously inflating the expandable bladder 36. It should be understood that any suitable type of air pump 20, or other source of pressurized air, may be utilized. The air pump 20 is shown as being mounted on a wall behind the tank of the toilet 12 and delivering air through line 22. It should be understood that the air pump 20 may be positioned in any other suitable location adjacent the toilet 12.

Figure 3:
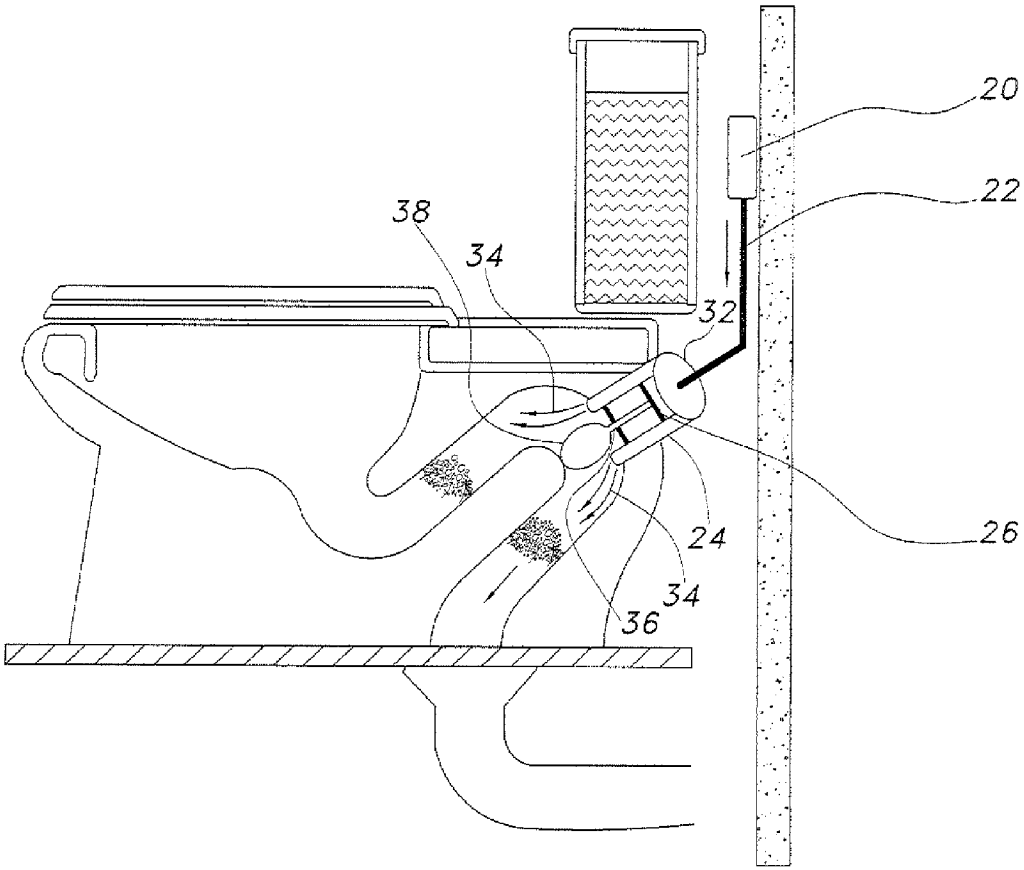
FIG. 3 is a diagrammatic side view in section of the system for unclogging toilets of FIG. 1, showing the expandable bladder in a deployed state.

As shown in FIG. 3, the injection of the pressurized air into the hollow tube 24 causes the plunger 26 to move downward within the hollow tube 24 while simultaneously filling the expandable bladder 36 so that the free end 38 thereof forms a temporary barrier, fluidly separating either side of the bend 18 formed in the outlet pipe 14. The pressurized air also flows through conduits 50 and 52 (with the air flow being indicated in FIG. 3 by arrows 34) into a respective side of the pipe 14. This allows clogs C formed on either side to be simultaneously broken up by the pressurized air stream 34. When clogs C are removed, air is released from within the tube 24, thus deflating the bladder 36. In order to release the pressurized air, the air pump 20 may be actuated in reverse to create suction, thus deflating the bladder 36 and simultaneously retracting the plunger 26 within the tube 24. It should be understood that any suitable type of balloon or expandable bladder may be utilized.

It is to be understood that the present invention is not limited to the embodiments described above, but encompasses any and all embodiments within the scope of the following claims.

We claim:

1. A system for unclogging toilets, comprising:

a hollow tube having opposed upper and lower ends, the upper and lower ends being closed, the upper end having a port formed therethrough, the lower end having a pair of peripheral apertures and a central aperture formed therethrough, the hollow tube being adapted for mounting on a toilet so that the pair of peripheral apertures and the central aperture are in communication with an interior of a bend of a toilet outflow pipe;

a pair of conduits diametrically positioned within the hollow tube and mounted to an interior wall thereof, each of the conduits having open upper and lower ends, the upper ends of the conduits being located within the hollow tube, the lower ends of the conduits extending through a respective one of the peripheral apertures in the hollow tube;

a plunger slidably mounted within the hollow tube, the plunger having a pair of diametrically opposed recesses formed in a peripheral edge thereof for respectively receiving the pair of conduits, the plunger having a central opening formed therethrough, the plunger forming a fluid-tight seal with the hollow tube and external walls of the pair of conduits;

an expandable bladder having opposed fixed and free ends, the fixed end being open and the free end being closed, the fixed end being secured to a lower surface of the plunger about the central opening formed therethrough, the free end extending through the central aperture of the lower end of the hollow tube; and means for delivering pressurized air to the interior of the hollow tube through the port formed through the upper end of the hollow tube so that the plunger may be selectively driven downward within the hollow tube while simultaneously filling the expandable bladder and driving the pressurized air through the pair of conduits into the toilet outflow pipe;

whereby the expandable bladder expands to form a fluid-tight barrier separating opposed sides of the bend of the toilet outflow pipe so that the pressurized air flowing through the pair of conduits breaks up clogs formed on either side of the bend of the toilet outflow pipe when the pressurized air is delivered to the interior of the hollow tube.

2. The system for unclogging toilets as recited in claim 1, wherein said means for delivering the pressurized air to the interior of said hollow tube comprises an air pump.

3. The system for unclogging toilets as recited in claim 1, wherein said hollow tube is substantially cylindrical.

4. A system for unclogging toilets, comprising:

a hollow tube having opposed upper and lower ends, the upper and lower ends being closed, the upper end having a port formed therethrough, the lower end having at least one peripheral aperture and a central aperture formed therethrough, the hollow tube being adapted for mounting on a toilet so that the at least one peripheral aperture and the central aperture are in communication with an interior of a bend of a toilet outflow pipe;

at least one conduit mounted to an interior wall of the hollow tube, the at least one conduit having open upper and lower ends, the upper end of the at least one conduit being located within the hollow tube, the lower end of the at least one conduit extending through the at least one peripheral aperture;

a plunger slidably mounted within the hollow tube, the plunger having at least one recess formed in a peripheral edge thereof for receiving the at least one conduit, said plunger further having a central opening formed therethrough, the plunger forming a fluid-tight seal with the hollow tube and an external wall of the at least one conduit;

an expandable bladder having opposed fixed and free ends, the fixed end being open and the free end being closed, the fixed end being secured to a lower surface of the plunger about the central opening formed therethrough, the free end extending through the central aperture of the lower end of the hollow tube; and means for delivering pressurized air to the interior of the hollow tube through the port formed through the upper end of the hollow tube so that the plunger may be selectively driven downward within the hollow tube while simultaneously filling the expandable bladder and driving the pressurized air through the at least one conduit into the toilet outflow pipe;

wherein the expandable bladder expands to form a fluid-tight barrier separating opposed sides of the bend of the toilet outflow pipe so that the pressurized air flowing through the at least one conduit may break up a clog formed on one side of the bend of the toilet outflow pipe when the pressurized air is delivered to the interior of the hollow tube.

5. The system for unclogging toilets as recited in claim 4, wherein said means for delivering the pressurized air to the interior of said hollow tube comprises an air pump.

6. The system for unclogging toilets as recited in claim 4, wherein said hollow tube is substantially cylindrical.

* * * * *